US005661464A

United States Patent [19]

Bilak et al.

[11] Patent Number: 5,661,464

[45] Date of Patent: Aug. 26, 1997

[54] SNOW PACK STABILITY MONITOR

[76] Inventors: Roman Anthony Bilak, 49 Macewan Park Close N.W., Calgary, Alberta, Canada, T3K 3Z6; Larry Maurice Theriault, c/o Terralog Technologies Inc./Mountainwatch Inc. 840 7th Avenue S.W. Suite 900, Calgary Alberta, Canada, T2P 3G2

[21] Appl. No.: 722,222

[22] PCT Filed: Apr. 20, 1995

[86] PCT No.: PCT/CA95/00215

§ 371 Date: Oct. 23, 1996

§ 102(e) Date: Oct. 23, 1996

[87] PCT Pub. No.: WO95/30977

PCT Pub. Date: Nov. 16, 1995

[30] Foreign Application Priority Data

May 4, 1994 [GB] United Kingdom ..... 9408876

[51] Int. Cl.[6] ..... G08B 21/00

[52] U.S. Cl. ..... 340/690; 340/540; 340/601; 340/603; 340/689; 340/686; 73/784

[58] Field of Search ..... 340/690, 540, 340/626, 603, 601, 612, 689, 686, 668, 665, 932.2, 436; 73/784

[56] References Cited

U.S. PATENT DOCUMENTS

| | | | |
|---|---|---|---|
| 3,673,861 | 7/1972 | Handy | 73/784 |
| 3,992,927 | 11/1976 | Troeh | 73/784 |
| 4,291,581 | 9/1981 | Jacoby | 73/784 |
| 5,109,702 | 5/1992 | Charlie et al. | 73/784 |
| 5,177,471 | 1/1993 | Horibata et al. | 340/690 |
| 5,227,785 | 7/1993 | Gann et al. | 340/932.2 |
| 5,337,613 | 8/1994 | Kovari | 73/784 |

FOREIGN PATENT DOCUMENTS

| | | |
|---|---|---|
| 61169718A | 12/1986 | Japan . |
| 21062495A | 6/1990 | Japan . |
| 40052514A | 6/1992 | Japan . |

*Primary Examiner*—Jeffery Hofsass
*Assistant Examiner*—Benjamin C. Lee
*Attorney, Agent, or Firm*—Adrian Zahl

[57] ABSTRACT

Apparatus comprises a probe for measuring snow pack movement, comprising a mobile element adapted to contact and be displaced by the snow pack, a static element linked to the mobile element by linkage means and adapted to remain stationary relative to the ground, and measuring means to measure relative movement of the two elements. The mobile element comprises a wand (16; 166) adapted to be placed in contact with a snowpack and having tilt means (20(*a*); 20(*b*); 168) that permit the wand to tilt away from the vertical in response to lateral movement of the surrounding snow pack. The measuring means comprises a movement sensor (50; 170) connected to the wand that measures the resulting movement of the wand. Data relay means transmits electronic signals generated by the movement sensor to a remote data collection and storage means. The invention further comprises a method for measuring the condition of an avalanche-prone snow pack, employing one or more the probes, linked to a central data collecting and transmitting means, and transmitting the resulting information to a remote data measuring station.

23 Claims, 7 Drawing Sheets

SNOW PACK STABILITY MONITOR

FIELD OF THE INVENTION

The present invention relates to a method and apparatus for monitoring snow pack stability and avalanche occurrence.

BACKGROUND OF THE INVENTION

The study of snow mechanics and snow pack failure (i.e. avalanches) has been of significant worldwide interest in the last two decades. However, efforts to quantitatively measure snow mechanics parameters in a "field" environment as opposed to a laboratory study have been relatively isolated. A real time avalanche surveillance system that accurately measures mechanical behaviour of a snow pack within the start zone and avalanche track of an avalanche hazard zone is not currently available. Most avalanche monitoring technologies focus on understanding the avalanche behaviour after snow pack failure. For example, descent velocities and times may be analyzed within the track, and sheer stresses, snow levels and moisture content of the snow pack within the start zone may be measured. The existing field avalanche monitoring techniques for assessment of snow pack failure consist of the following:

"Glide Shoe" Technique: This technique involves installing a series of "glide shoes" along a mountain face between the snow pack and the ground. The glide shoe resembles a single-pronged hook which grips the overlying snow pack and comprises a mobile element that moves with the snow. Each shoe is connected to a rotating potentiometer that comprises a static element fixed to the ground. As the shoe moves with the snow over the ground, a voltage change is registered which can be calibrated to an actual displacement reading. This technique is used for monitoring snow pack movements associated with glide avalanches.

Snow Profiling: This technique involves a person digging a shallow pit through the entire area of the snow pack, next to the avalanche-prone area. With the section of snow exposed, physical measurements are made of the snow pack layering, snow crystal shapes and sizes, density of layers, hardness of layers, and temperature, every 10 centimetres along the section. The data are evaluated to determine failure potential.

Snow Shear Test: This technique is used in conjunction with the snow profiling technique. A column of snow is isolated so as to be free-standing in a shallow pit. The blade of a shovel is inserted into the various snow layers and then slowly pulled out at a constant force. If the layer is weak, it will fail in shear as the shovel blade is removed. Although this technique is subjective, if the tester is experienced, the test can provide a good indication of the relative shear Strengths of the snow pack layers.

All of the existing techniques suffer from the drawback that they fail to provide real time continuous readings regarding changes occurring in the snow pack prior to and during the occurrence of an avalanche. As well, the prior art typically applies subjective, non-quantitative tests.

Studies of the mechanics of snow slab failure have shown that rates of movement (creep or glide), temperature and acoustic emissions within the Start zone of an avalanche slope are of interest in evaluating the stability of a snow pack. The rate of movement and temperature may serve as predictors of an avalanche event. On this basis, the applicants have developed a snow pack monitoring and surveillance system to enable the recording of snow pack transient movements, temperature and optionally acoustic emissions in real time. As well, it is desirable to provide a means for remotely detecting the occurrence of an avalanche and measuring its speed, by means of a detector, capable of withstanding an avalanche, installed within an avalanche track.

It is desirable-to provide a snow pack monitor that has one or more of the following benefits:

a) It should allow for the detection and measurement of movement of the entire snow pack relative to the slope base of the mountain.

b) It should allow for the detection and measurement of movement of the snow layers along weak layers within the snow pack which may indicate a shear failure mode such as typical of dry-slab avalanches.

c) It should allow for the vertical profiling of movement within the snow pack.

d) It should allow for the detection, measurement and profiling of temperature changes in the snow pack which may signal an impending avalanche.

e) The installation of the sensor probe should involve no disruption to the snow pack.

f) The monitoring and surveillance should be done remotely, outside the range of the avalanche and without danger to monitoring personnel.

g) The monitor should be adaptable to monitor actual avalanche activity in real time on an "indicator slope", i.e., a slope subject to frequent avalanches, where avalanche activity is indicative of avalanche risks generally in the region.

DISCLOSURE OF THE INVENTION

The invention relates to a method and apparatus for measuring snow conditions and movement within an avalanche-prone area. The apparatus comprises a probe for measuring snow pack movement, of the type that comprises a mobile element adapted to contact and be displaced by the snow pack, a static element linked to the mobile element by linkage means and adapted to remain stationary relative to the ground, and measuring means to measure relative movement of the two elements. The improvement in the apparatus that comprises the present invention resides in the provision of the mobile element comprising a wand adapted to be placed in contact with a snowpack and having tilt means that permit the wand to tilt away from the vertical in response to lateral movement Of the surrounding snow pack. One end of the wand is linked to a static element by linkage means. The wand is adapted to achieve a generally vertical orientation when in its rest position. The measuring means comprises a movement sensor connected to the wand that measures the resulting movement of the wand. Data relay means transmits electronic signals generated by the movement sensor to a remote data collection and storage means.

In a preferred embodiment, one or more probes are linked to a datalogger/transmitter unit, which may be positioned outside the avalanche area, for the periodic recordal of data generated by the movement sensor within each probe. The datalogger/transmitter unit further includes data transmission means for transmitting the data stored therein to a remote base station. The data transmission means may comprise a radio transmitter/receiver for the two way radio communication between the unit and the base Station, or a cellular telephone link to the base station.

The method comprises in its broadest form the placement of one or more probes, as described above, within an avalanche hazard zone. The probes are then operatively linked to a data transmission means positioned outside the avalanche hazard zone. The data transmission means transmits signals generated by the movement sensors within the probes to a base station remote from the avalanche site.

A first preferred embodiment of the apparatus is particularly useful for surveillance of a snow pack in the region known as an avalanche "start zone". The static element of the first embodiment comprises a base adapted to be anchored to a rock face or earth surface. The wand is segmented, with each segment comprising a rigid tubular member, such as length of PVC pipe. A resilient flex means, such as a spring means, links adjoining segments, and as well links the lowermost segment to the base. The spring means permits the segments to resiliently flex in relation to each other in response to movement of layers within of the snow pack. Such flexing permits the detection of at least two types of movement: movement of the entire snow pack relative to the face of the mountain, and movement of snow layers relative to each other, typically along weak layers within the snow pack. The latter movement may indicate shear failure mode typical of dry slab avalanches.

Inside each segment is inserted one or more temperature sensors and a movement sensor. The temperature sensors may each comprise a standard thermocoupling device, which generates a voltage that varies with changes in temperature. The movement sensor may be a tilt meter device, which may be of the pendulum or electrolytic type, which generates a voltage signal based on varying angle of tilt. Optionally, at the base of the probe may be connected an acoustic sensor, such as a standard geophone as used in geophysical applications, to measure sounds generated by the snow pack.

The output voltage lines from each of the sensors is wired to a datalogger/transmitter unit. The output voltage lines are preferably multiplexed into a multichannel signal processor allowing for multiple sensor units to be simultaneously monitored. The voltage lines from each sensor are passed through an analog-to-digital converter and then passed on to a microprocessor control unit which periodically polls each sensor and stores the related voltage value unit in its data memory storage area. The microprocessor control unit also interfaces with a radio modem for transmittal of the data to a base station.

The base station consists of a computer connected to a radio modem and antenna which relays and receives the data transmitted by the datalogger/transmitter unit at the monitoring site. The base station computer system is operated by software permitting the storage, processing and analysis of the sensor data. Processing and analysis performed by the base station computer include: calculating the rate of change of the measured data for each sensor (first derivative); calculating the acceleration of the measured data; Fourier-transform analysis of the data (spectrum power density versus frequency analysis) to determine high and low power frequency behaviour of the recorded data; generating data plots which display a vertical profile through the snow pack; simultaneous cross section plots of data; and an efficient on-line base routine for acquisition and archiving of recorded monitoring data.

In a second preferred embodiment of the apparatus, the invention is adapted to signal the occurrence of an avalanche within an avalanche "track", i.e., an area of frequent avalanche activity. For this purpose, the probe is adapted to be suspended from a transverse member, such as a cable, spanning an avalanche track. The transverse member comprises the static element of this embodiment. The probe comprises a rigid wand, having a weighted lower end to minimize unwanted swaying. The probe is provided with a tilt meter adapted to signal when the tilt of the probe exceeds a predetermined minimum, for example when the wand is knocked ajar by the occurrence of an avalanche under the probe. The apparatus further comprises a datalogger/transmitter unit as in the first embodiment, operatively linked to the probe. A preferred embodiment of the apparatus comprises multiple probes suspended along a track, linked to a datalogger/transmitter unit that may be positioned outside of the track.

A first preferred embodiment of the method comprises the initial step of anchoring a number of sensor probes of the first embodiment to a mountain face within an avalanche start zone. The installation is done during a season when the area to be monitored is most accessible. The base of each probe is anchored to the ground or mountain face using conventional anchoring techniques. Each probe is adapted to measure and monitor the characteristics and movement of the snow pack, by means of the various sensors described above, with periodic readings recorded and stored in a datalogger/transmitter unit, which is outside the monitoring area. The data in the datalogger/transmitter unit is accessed remotely through the transmitter receiver and is downloaded periodically to a base station. The base station provides for the display and analysis of the data gathered by the probe sensors.

The second preferred embodiment of the method comprises the suspending of one or more wands of the second embodiment of the apparatus from one or more transverse cables spanning an avalanche track. The provision of multiple wands permits the operator to obtain greater detail on the size of the avalanche, minimizes the risk of spurious signals being transmitted by the probe, and where the probes are arranged linearly along the avalanche track, permits the measurement of the speed of the avalanche. The movement sensors within the probes are adjusted so as to generate a signal only when the probe is tilted by an amount greater a predetermined degree, e.g., the degree determined to likely result from normal swaying as a result of wind and the like.

The probes are operatively linked by wire to a datalogger/transmitter unit as described above, positioned outside the avalanche track. The unit is adapted to receive information transmitted by the movement sensors within the probes, transmit the information by radio or cellular telephone to a remote base station, and to receive instructions transmitted from the base station by radio or cellular telephone.

BEST MODES FOR CARRYING OUT THE INVENTION

Figure 1:
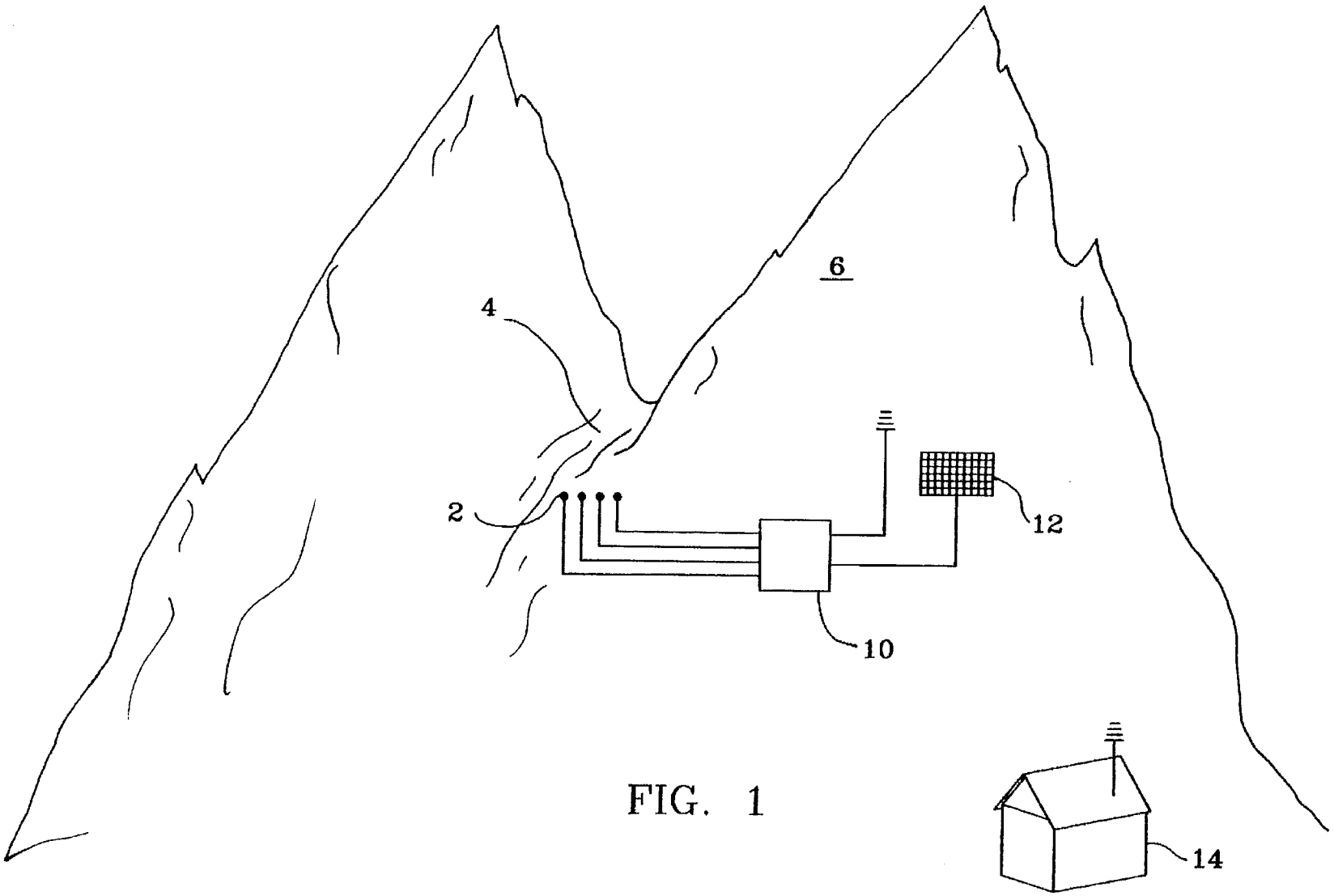
FIG. 1 is a schematic view of a first preferred embodiment of the invention installed on a mountain face.
Figure 2:
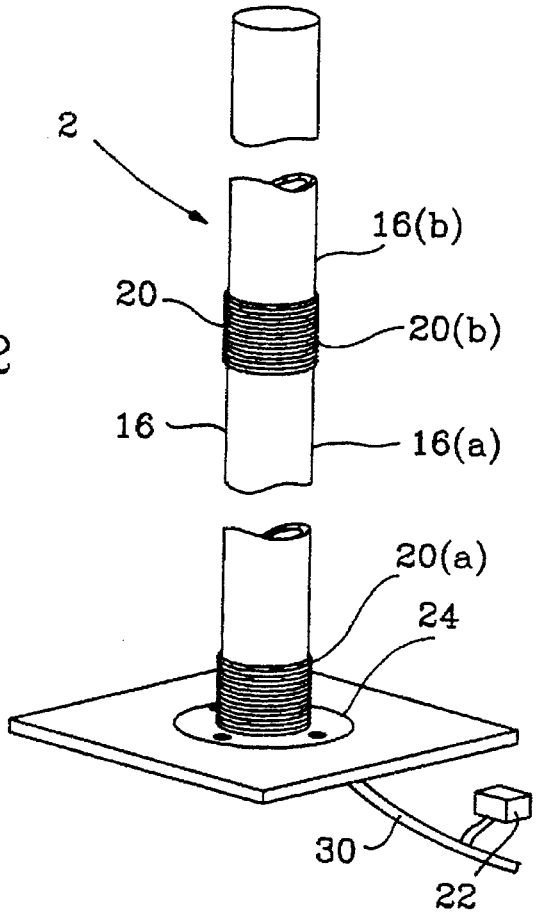
FIG. 2 is a side view of the sensor probe of the first embodiment.

Referring to the drawings there is illustrated in FIG. 1 an overview of the invention set in a mountainous area. Depicted are sensor probes 2 which are further described in FIGS. 2–7, placed in an avalanche start zone 4 of an avalanche area 6. The sensor probes 2 are wired to a data collection, storage and transmission means, which comprises datalogger/transmitter unit 10. The unit 10 is powered using a solar panel 12, and is further described below. Data is downloaded from the datalogger/transmitter unit 10 to base station 14 where it is analyzed and displayed and plotted. As seen in FIG. 2, the mobile element of sensor probe 2 consists of a wand comprised of one or more rigid tubular segments 16. In the first preferred embodiment, the body of each segment is comprised of PVC. The segments may vary in length from about six inches to four feet, and in diameter from about ¼ inch to three inches. The length and diameter selected for the segments will depend the terrain, snow loading conditions, weather conditions, the type of avalanches likely to occur, and the resolution of the data which is desired to be collected. At the base of each segment is attached tilt means, comprising a resilient connection member which preferably comprises a spring 20, which permits the segment to tilt away from the vertical with the movement of the snow pack. The connection members are adapted to permit the segments to resiliently flex relative to the base or to each other, thus permitting them to return to a normal vertical position when the lateral pressure imposed by the snow pack is removed. The term "resilient" as used herein means the property of flexing upon application of a force and subsequently returning to a rest position. In the preferred aspect of the invention, the spring 20(*a*) that links the lowermost segment 16(*a*) to the base plate 24 is of heavier gauge than the springs 20(*b*) et seq. that link the segments together. Optionally, connected to the bottom of the probe is an acoustic sensor 22 such as a geophone. The base plate 24 comprises the static element of the probe, and is anchored to the underlying ground surface by conventional anchoring techniques. The power supply inputs and outputs of the various sensors is carried out of the sensor probe through signal cable 30 to the datalogger/transmitter unit 10, which is located in a protected area away from the slide area.

Figure 3:
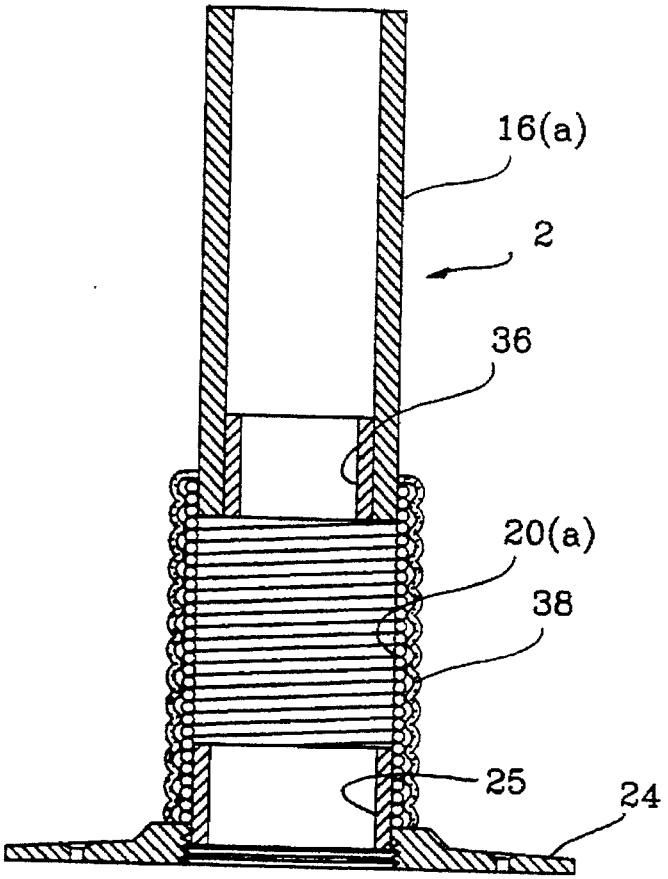
FIG. 3 is a sectional view of a base spring portion of the probe.

Referring to FIG. 3, the first spring 20(*a*) is fitted over base adapter 25 extending upwardly from the base plate 24. The lower portion of segment 16(*a*) is optionally reinforced with reinforcement section 36. Each spring 20 is covered with an ice and water resistant elastomeric boot 38.

Figure 4:
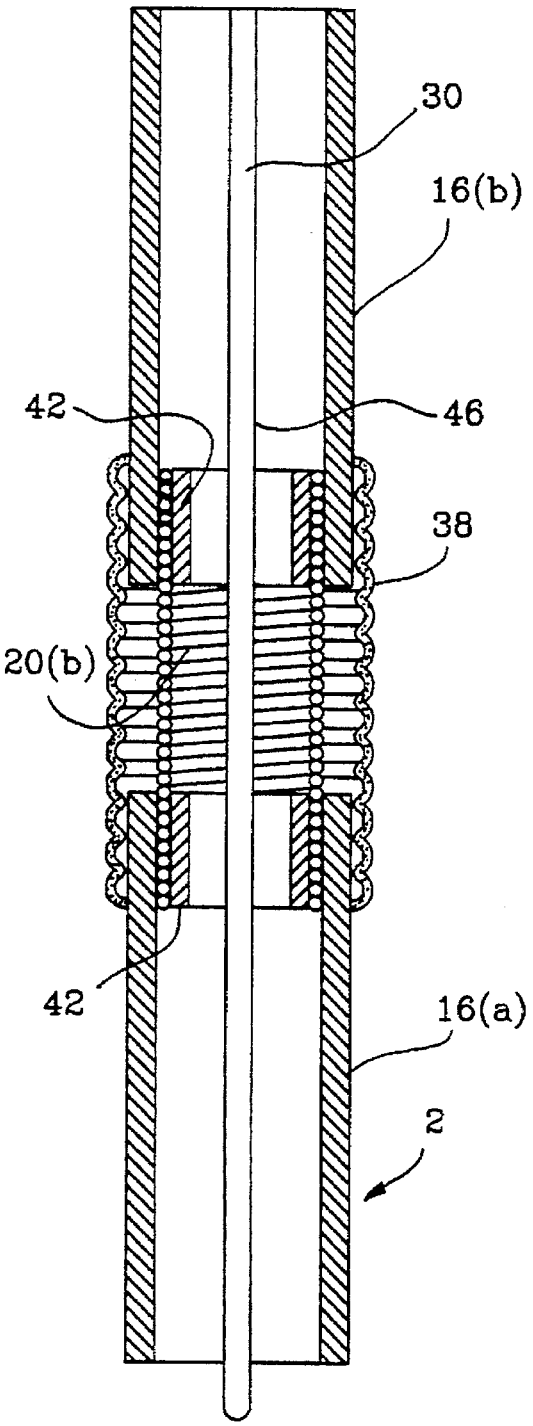
FIG. 4 is a sectional view of a connecting spring portion of a probe.

Referring to FIG. 4, each of segments 16(*a*) and (*b*) is optionally reinforced with reinforcement section 42 adjacent their respective ends facing the interposed spring 20(*b*). An electrical conduit 46 carries the signal cable 30 to the various sensors mounted within each segment. The signal cable comprises data relay means which permits the signals generated by the sensors to be transmitted away from the probe.

Figure 5:
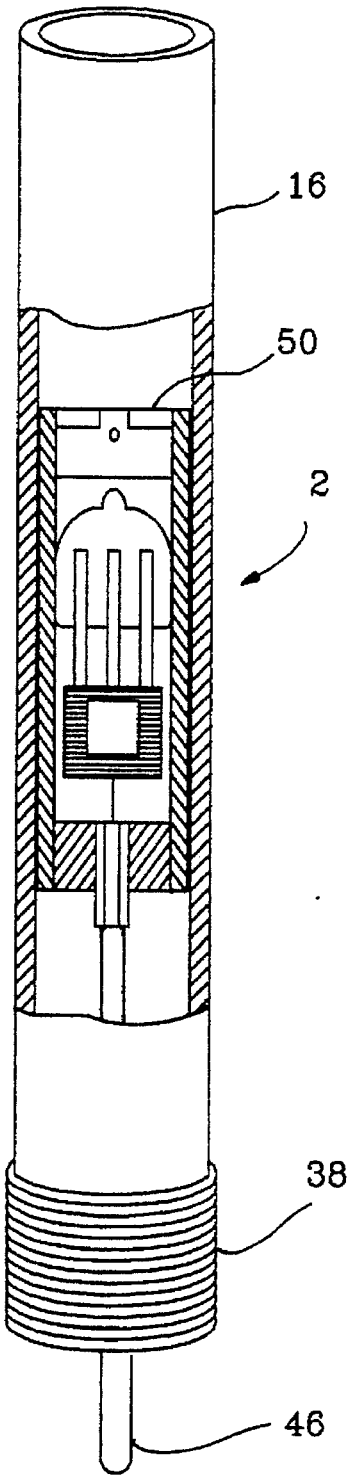
FIG. 5 is a sectional view of a probe segment.

Referring to FIG. 5, one or more of the segments houses a measuring means comprising a tilt and temperature sensor 50. The electrical conduit 46 carries the power and the inputs and outputs for the tilt and temperature sensor. The electrical conduit 46 optionally continues through the segment 16 for connection to the next segment. Optionally, additional temperature sensors may be incorporated into the segment if it is desired to measure the temperature of the snow pack at more closely-spaced intervals.

Figure 6:
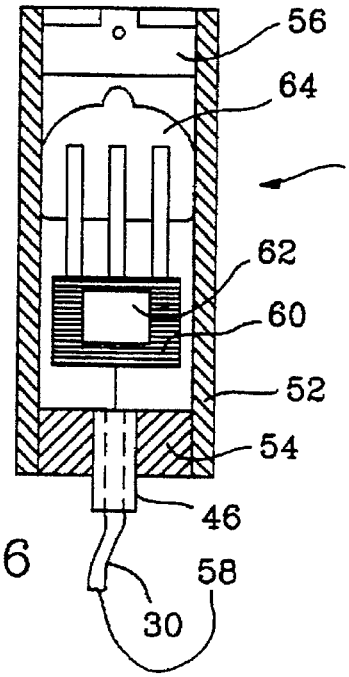
FIG. 6 is a side elevational view of a first embodiment of a tilt meter and temperature sensor.

FIG. 6 illustrates the measuring means, which in this embodiment incorporates a tilt meter and a temperature sensor. The sensor is housed within a sensor housing 52, which is terminated with a bottom seal 54. The top of the sensor housing is capped with alignment key 56. The signal cable 30 is housed within electrical conduit 46 and carries input and output voltage signals through electrical wires 58 for signal conditioning unit 60 and temperature sensor 62. The tilt meter 64 comprises a biaxial electrolytic transducer which generates output voltages that vary with the degree of tilt of the meter. Output voltages from the meter 64 are carried through the signal cable to the datalogger/transmitter unit 10.

Figure 7:
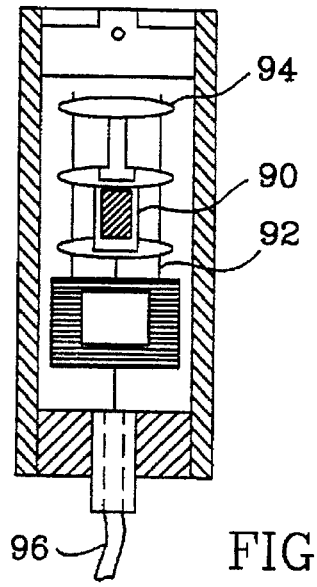
FIG. 7 is a side elevational view of a second version of a tilt meter and temperature sensor for use in the first embodiment.

FIG. 7 depicts a second embodiment of a tilt and temperature sensor. In this embodiment, the tilt meter 90 comprises a biaxial cantilever pendulum type beam transducer which generates output voltages that vary with the tilt of the sensor. The tilt meter 90 is supported by vertical rod supports 92 and centralizer support 94. Output voltages from the transducer are carried through the signal cable 96 to the datalogger/transmitter unit 10.

Figure 8:
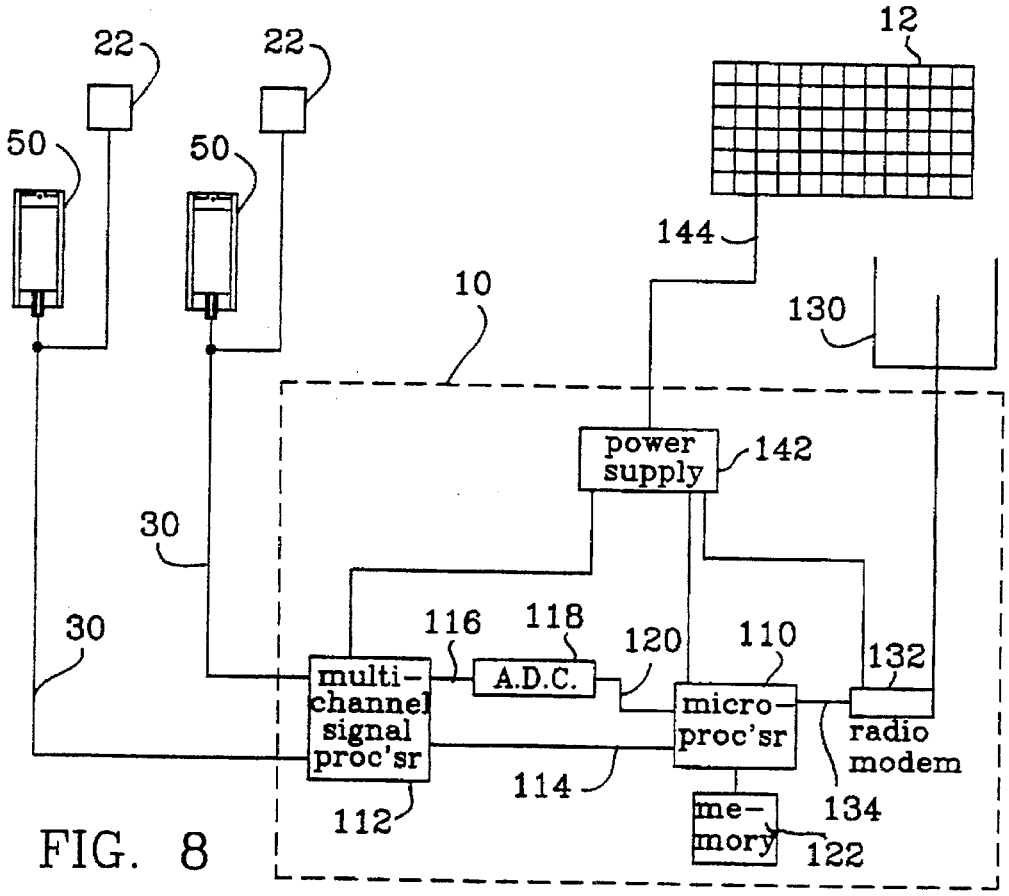
FIG. 8 is a schematic view of the first embodiment of the device.

Referring to FIG. 8, power and DC voltage inputs and outputs to multiple tilt and temperature sensors 50, and optionally to one or more acoustic sensors 22, are carried from datalogger/transmitter unit 10 through signal cable 30. A microprocessor 110 controls the operation of the datalogger/transmitter unit 10. The microprocessor 110 polls the output voltage of each sensor by directing a multichannel signal processor 112 through control line 114 to transmit the output voltage from a specific sensor through the multichannel signal processor output line 116 into an analog-to-digital converter 118 which transmits the digital voltage value through input line 120 to the microprocessor 110.

Microprocessor 110 periodically polls the voltage lines on multichannel signal processor 112 and receives digital values for each one of the voltages. The rate of polling is dependent upon the degree of resolution of data desired and the limits of the data memory storage area 122, which stores digital voltage values for each sensor.

To download data, a radio signal from the base station 14 (seen in FIG. 9) is received on antenna 130 and sent through radio modem 132 along control line 134 to microprocessor 110. In response to the signal to download data, microprocessor 110 extracts and downloads the voltage values logged for each sensor and stored in the data memory storage area 122 to radio modem 132 which is transmitted through antenna 130 to the base station. The radio modem 132 in the preferred embodiment is a commercially available device consisting of an EFJ radio and an RF 95M modem as is used in typical radio modem applications.

Optionally, data may be transmitted to the base station by way of a cellular telephone linkage, not shown.

The power supply system is typical of that used in commercial remote power applications., with power generated by a solar panel 12 and provided to the power supply 142 through power line 144. The power supply 142 supplies power to the multichannel signal processor 112, the microprocessor 110, and the radio modem 132.

Figure 9:
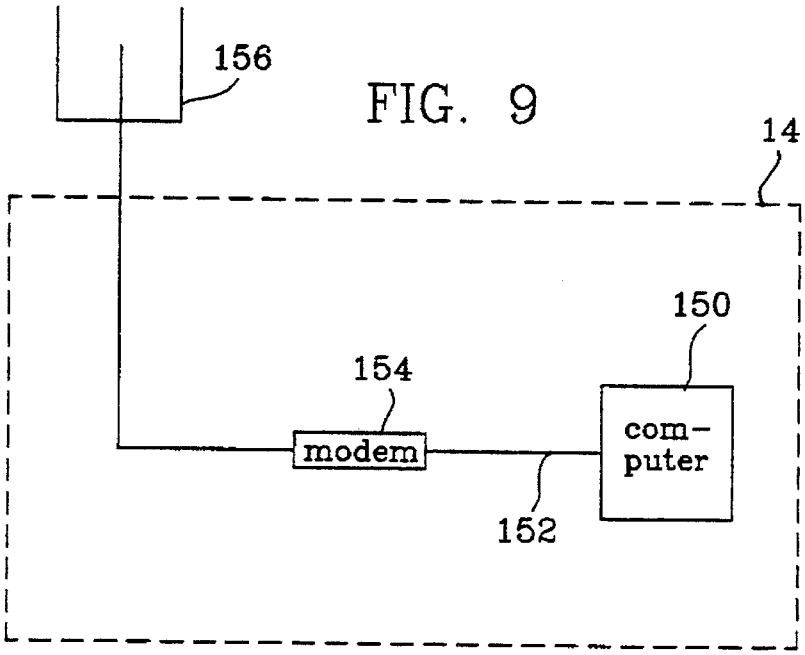
FIG. 9 is a perspective view of a base station.

Referring to FIG. 9, base station 14 comprises computer system 150 which is connected through data and control line 152 to a radio modem 154. Upon a signal sent from computer system 150 through control line 152, radio modem 154 transmits a radio signal through antenna 156 to the datalogger/transmitter unit. Antenna 156 and radio modem 154 are standard commercially available devices and are compatible with the receiving equipment.

Computer system 150 is under software control and provides for the data storage analysis and display of the data as well as communication with the datalogger/transmitter device. In the preferred embodiment, there is provided a Campbell Scientific Inc. (tm) datalogger system, linked to a conventional microcomputer adapted to analyze the data in various ways, including providing for the calculation of the rate of change of the measure data for each sensor (1st derivative), calculating the acceleration (second derivative) of the measured data, performing Fourier-transform analysis of the data, providing database access and archiving routines for the storage and retrieval of the data and providing for the output, in graphical and plotted forms to a display screen or various pointer and plotter devices.

Figure 10:
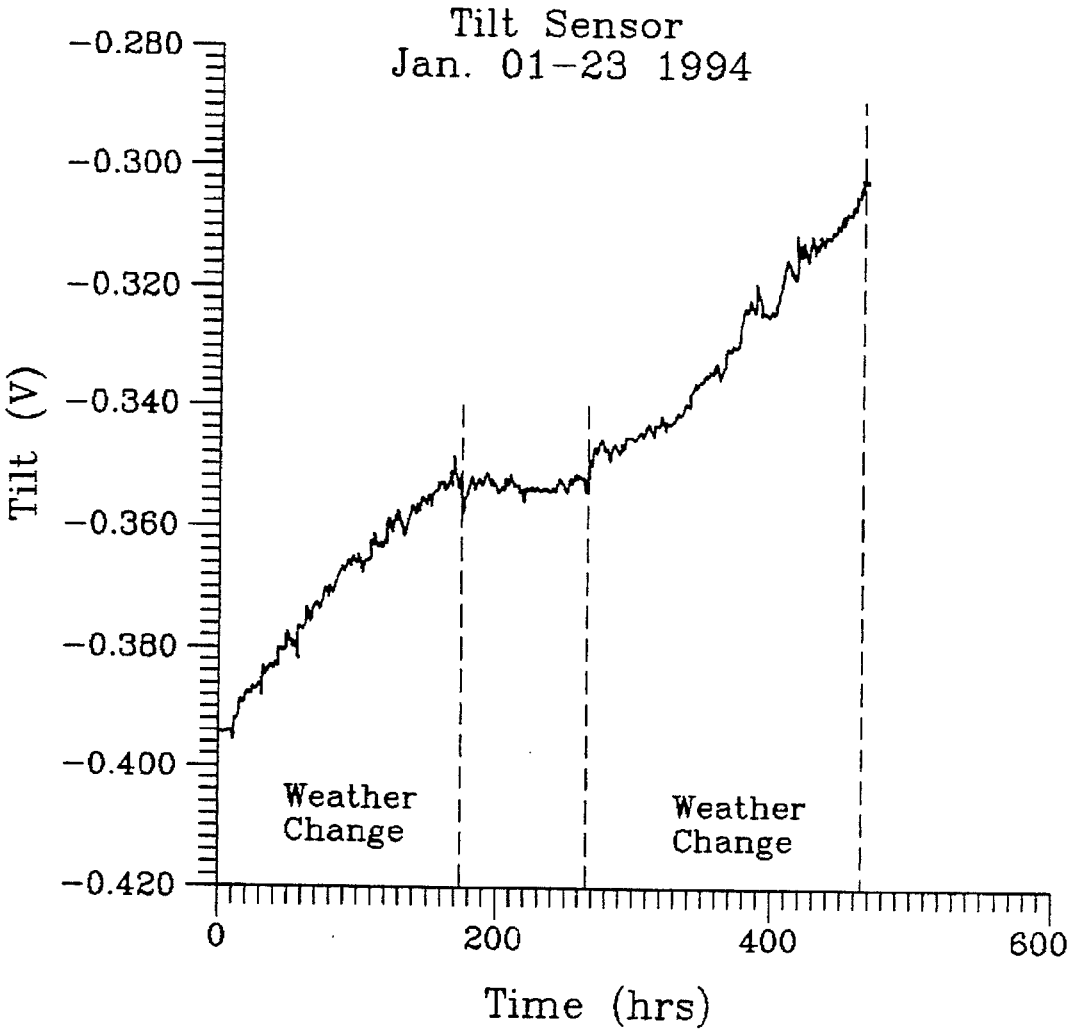
FIG. 10 is a graph illustrating voltage output from a tilt meter sensor plotted against time.

FIG. 10 illustrates a typical response graph generated at base station 14, showing a progressively advancing degree of tilt of the probe. The degree of tilt exhibits more pronounced change during periods of changing weather.

The preferred method for measuring snow pack conditions employing the first embodiment of the apparatus comprises the initial step anchoring a number of sensor probes as described above to a mountain face in the region to be monitored. The installation is done during a season when the area to be monitored is most accessible. The base of each probe is mounted on the ground or mountain face using conventional anchoring techniques. The datalogger/transmission unit is positioned apart from the probes, away from the avalanche zone. Each probe is adapted to measure and monitor the characteristics and movement of the snow pack, by means of the various sensors described above. When the system is activated during the snow season, periodic readings from the probes are recorded and stored in the datalogger/transmitter unit. The data in the datalogger/transmitter unit is accessed remotely through the transmitter/receiver and is downloaded periodically to the base station. The base station provides for the display and analysis of the data gathered by the probe sensors, as shown in FIG. 10.

Figure 11:
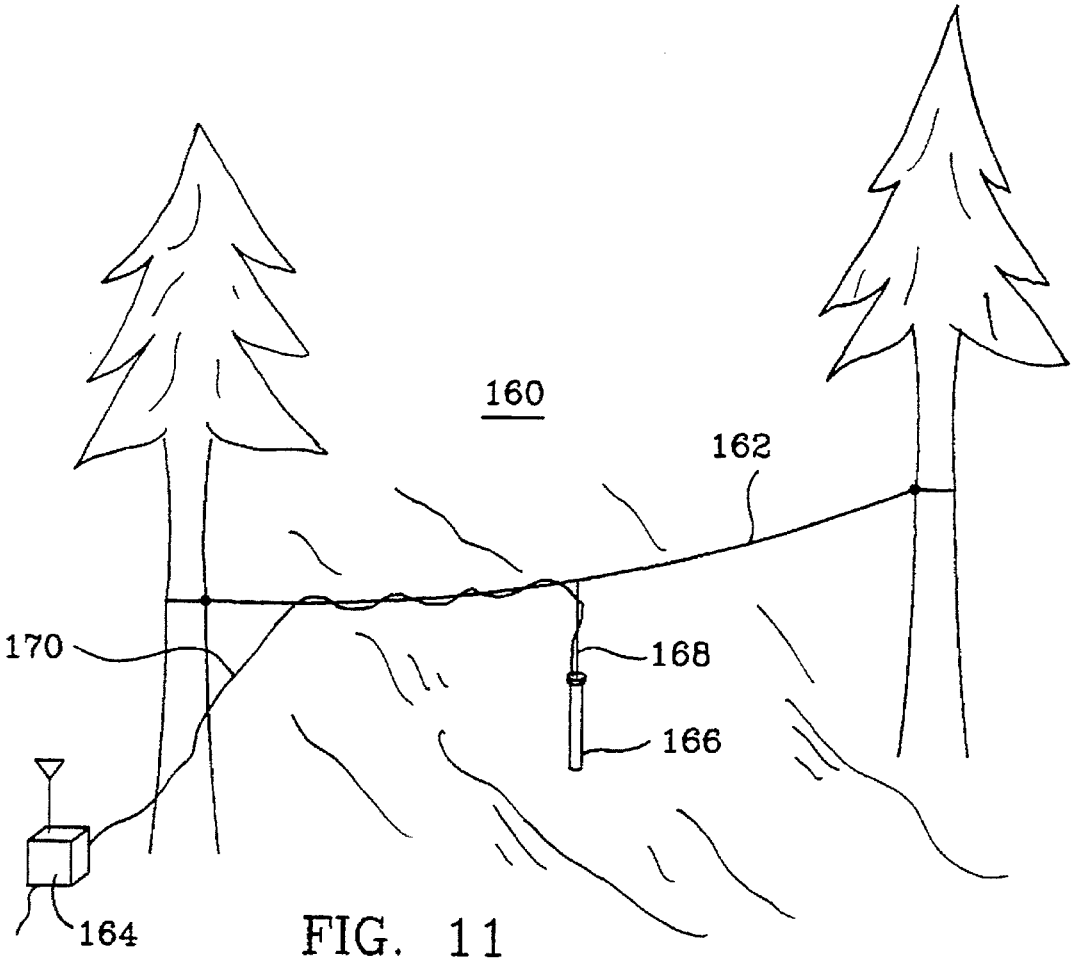
FIG. 11 is a schematic view of a second embodiment of the invention.
Figure 12:
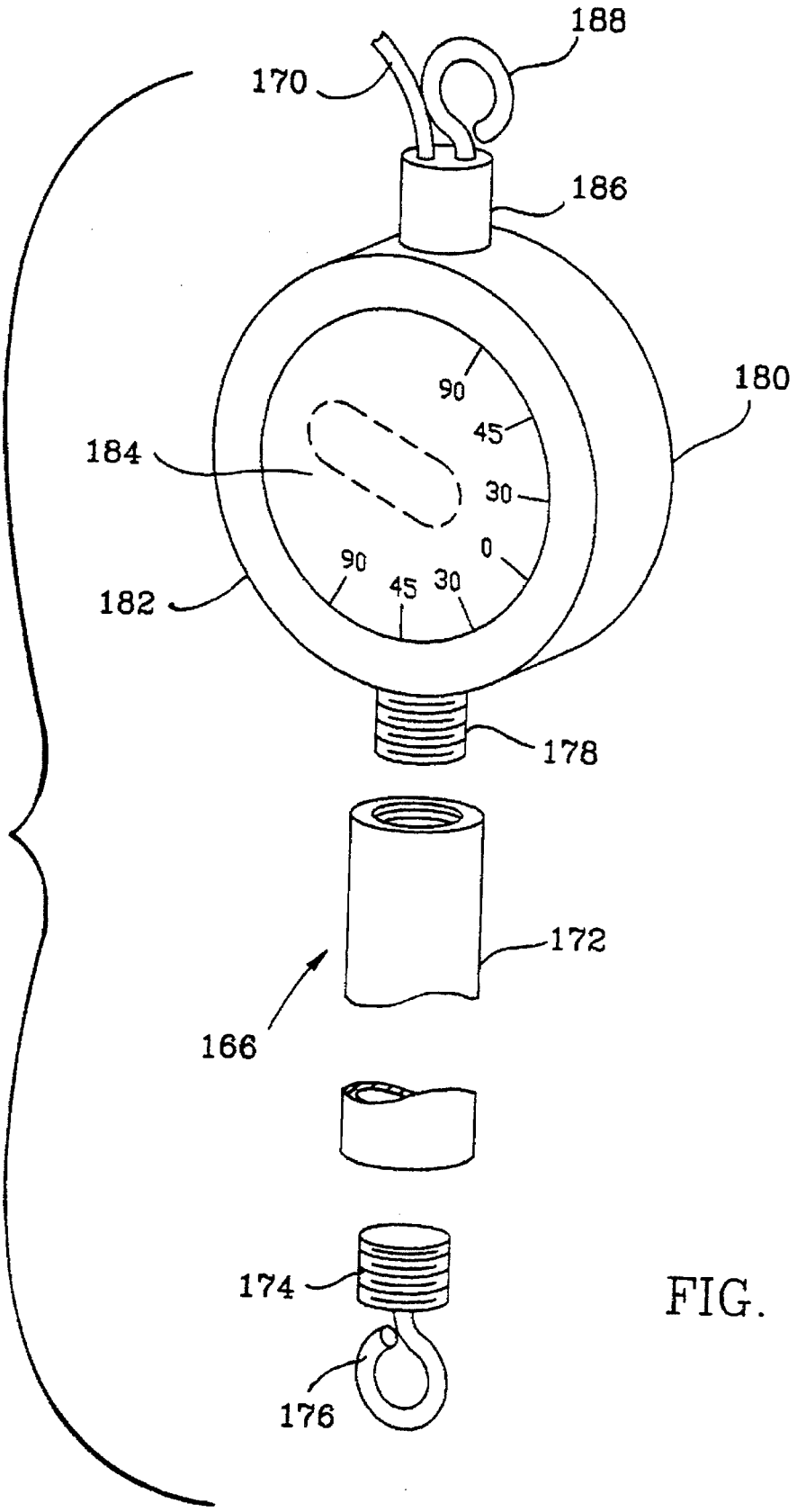
FIG. 12 is a perspective view of the wand portion of a probe according to the second embodiment.

A second embodiment of the invention is illustrated in FIGS. 11 and 12. This embodiment is adapted to be positioned within an avalanche track 160 to detect the occurrence of an avalanche. Since the extreme conditions within an avalanche track zone could damage or destroy a ground-mounted detector, the static element of this embodiment comprises a transverse element, such as a cable, that suspends the mobile element above the normal snow level.

As seen in FIG. 11, a transverse cable 162 may be fixed between two trees or other upright members such as pylons on either side of the avalanche track. A logger/transmitter unit 164 is positioned outside the avalanche track 160. The logger/transmitter unit is essentially identical to that of the first embodiment described herein, except that it need be adapted only to process data received from a single tilt sensor for each probe. The logger/transmitter unit is in radio or cellular telephone communication with the base station and is powered by a solar panel, not shown, in the same manner as the first embodiment. The unit may also be adapted to transmit a radio signal that is receivable as an audible signal, which is transmitted whenever the measuring means detects that an avalanche event has occurred, i.e., whenever movement of the wand triggers the measuring means. This aspect permits the device to serve as a warning device to indicate when an avalanche has occurred within the track. This signal serves to warn of high avalanche hazard within the region around the track. The mobile element of the probe comprises a rigid wand 166 suspended from the transverse cable 162 above the track 160, by means of a suspension cable 168. The base of the wand is typically suspended about one meter above the snow, with the distance determined by the nature of the avalanches expected within the track—these may require the wand to be suspended as much as several meters above the normal snow level. As snow accumulates during the season, the wand may be periodically elevated by raising the transverse cable 162 or shortening the suspension cable 168.

The wand 166 is operatively connected to the logger/transmitter unit by means of a signal cable 170.

Referring to FIG. 12, the wand 166 is provided with a tilt meter mounted to the top thereof. The wand comprises a PVC casing 172, having a plug 174 threaded into its lower end. The plug may be provided with a hook 176 for optional attachment to guying cables, not shown. The casing 172 is weighted by being filled with sand, lead shot or other heavy substance. The upper end of the casing is capped by a PVC coupler 178 threaded into the upper end of the casing. The coupler 178 mounts a tilt meter 180 to the wand, with the tilt meter being rotatably mounted within a housing 182. The tilt meter is of the "dial-a-tilt" type that may be adjusted to emit signals only when it has been tilted beyond a specified predetermined trigger angle. The desired trigger angle is set by an adjustment dial 184 located on the front of the housing. The tilt meter is preferably of the transducer type described above.

A hook anchor 186 extends from the upper face of the tilt meter housing, to which is mounted a hook 188 for engagement. Of the wand to the suspension cable. The signal cable 170 enters the tilt meter housing through the hook anchor, and is linked to the tilt meter within the housing.

The collection and transmission of data from the device is essentially the same as that described above in connection with the first embodiment, the only difference being that only tilt data is collected and transmitted.

In a complete system for detecting the occurrence of avalanches, it may be desirable to install multiple probes, either from a single transverse cable or from multiple cables. This permits the detection of avalanches that might bypass a single detector, and minimizes "false positive" data that might result from local wind conditions or animal or human interference with the probes. As well, multiple probes arranged linearly along the avalanche track permits the user to measure the speed of an avalanche.

The method of compiling data from the second embodiment is similar to that of the first embodiment. Preferably, multiple probes are positioned at various positions within the avalanche track. Data from the tilt meters within the probes is collected by the logger/transmitter unit. The data is downloaded periodically to the remote base station 14, as shown in FIGS. 1 and 9, for analysis.

Although the present invention has been described by way of preferred embodiments thereof, it will be seen to those skilled in the art to which the invention relates that numerous variations may be made thereto without departing from the spirit and scope of the invention, as defined by the appended claims.

We claim:

1. A probe for measuring avalanche snowpack condition, of the type adapted to measure movement of a snowpack relative to the ground and comprising a static element adapted to remain fixed in position relative to the ground, a mobile element linked to said static element by linkage means, said mobile element adapted to contact a snow pack and translate movement of said snow pack into displacement of said mobile element; and measuring means to measure movement of the mobile element in relation of the static element and thereby determine movement of the snowpack, wherein the improvement resides in the provision of: a mobile element comprising a wand (16; 166), one end of which is linked to said static element by linkage means (20); said linkage means being adapted to retain said wand in a generally upright rest position; resilient flex means (20(*a*); 20(*b*); 168) to permit said wand to tilt in response to lateral pressure imposed by lateral shifts in or within said snow pack; measuring means comprising a tilt meter (50; 180) mounted to said wand adapted to measure movement of said wand; and data relay means (30; 170) to transmit signals generated by said tilt meter to a remote data collection means.

2. A probe as claimed in claim 1, wherein said tilt meter comprises a biaxial electrolytic transducer (64).

3. A probe as claimed in claim 1, wherein there is further provided temperature sensing means (62) within said probe adapted to measure the temperature of the surrounding snow pack, said temperature sensing means being operatively linked to said data relay means (30).

4. A probe as claimed in claim 1, wherein there is further provided an acoustic detector (22) within Said probe for detection of acoustic signals generated within said snow pack, said acoustic detector being operatively linked to said data relay means.

5. A probe as claimed in claim 1, wherein said data relay means (30; 170) is adapted to transmit a radio signal receivable at an audible frequency upon movement of said wand.

6. A probe as claimed in claim 1, wherein said static element comprises a base adapted to be anchored to the ground and said wand extends generally upwardly from said base and comprises multiple rigid segments (16(*a*) and (*b*)) having resilient flex means (16) interposed between said segments, said resilient flex means adapted to permit said segments to resiliently flex relative to each other in response to lateral movement by portions of the surrounding snow pack, each of said segments incorporating a tilt meter (50) and data relay means (30).

7. A probe as claimed in claim 6, wherein each of said segments is further provided with temperature sensing means (62) linked to a corresponding of said data transmittal means and adapted to measure to the temperature of a portion of the surrounding snow pack.

8. A probe as claimed in claim 6, wherein said resilient flex means comprises a spring means (20).

9. A probe as claimed in claim 1, wherein there is further provided data collection, storage and transmission means (10) adapted to receive signals generated by said tilt meter, store said signals and communicate with a remote data measuring station (14) to receive instructions from said data measuring station and transmit said signals to said data measuring station.

10. A probe as claimed in claim 9, wherein said data collection, storage and transmission means is provided with means (110) to retrieve said signals from said tilt meter on a periodic basis.

11. A probe as claimed in claim 1, wherein said static element comprises a transverse member (162) adapted to be fixed above an avalanche slope, and said resilient flex means and said linkage means comprise a cord means (168) adapted to suspend said wand from said transverse member and to permit said wand to be displaced angularly upon contact-of said wand with said snow pack during an avalanche event.

12. A probe as claimed in claim 11, wherein said tilt meter (180) is adapted to transmit electronic signals in response to a tilt of said wand beyond a predetermined minimum degree of tilt from the vertical.

13. A probe as claimed in claim 12, wherein said tilt meter is provided with trigger angle adjustment means (184) to adjustably set said minimum degree of tilt from the vertical.

14. A method for measuring the condition of an avalanche-prone snow pack lying on a portion of ground, said method being of the type comprising measuring the movement of said snow pack relative to said ground by means of a probe comprising a static element adapted to be fixed in position relative to the ground, a mobile element adapted to translate movement of an avalanche-probe snow pack into displacement of said mobile element, linkage means adapted to engage link said static and mobile elements, and measuring means adapted to measure relative movement between said static and mobile elements, said method comprising the steps of: fixing one or more static elements to the ground in an avalanche-prone area; permitting a snow pack to contact said mobile element; measuring movement of the mobile element in relation to the static element; collecting and storing information relating to said movement, and analyzing said information; wherein the improvement in said method resides in the steps of supporting in a generally upright position a mobile element comprising a wand (16; 166) in a position to contact said snow pack, and wherein each of said mobile elements incorporates measuring means comprising a tilt meter (50; 180) adapted to generate an electronic signal in response to movement of said wand, and transmitting said electronic signal by signal transmission means (30; 170) to a data measuring station (14) remote from said probe.

15. A method as claimed in claim 14, further comprising the steps of linking said probes to a central data collection, storage and transmission unit (10; 164), transmitting said electronic signals from said probes to said unit, storing said information in a machine-readable form within said unit, and transmitting said information on a periodic basis by radio transmission to said data measuring station.

16. A method as claimed in claim 14 wherein said electronic signals are transmitted from said probes to said unit on a periodic basis, when polled by said unit.

17. A method as claimed in claim 14, comprising the additional step of measuring the lateral displacement of said snow pack at more than one vertical position within said snow pack, by providing each of said probes with a segmented wand and multiple tilt meters, each of said tilt meters being incorporated into one of said segments, said segments being joined by resilient flex means (20(*b*)).

18. A method as claimed in claim 14, comprising the further step of detecting acoustic emissions generated within said snow pack by means of an acoustic detector (22) positioned within at least one of said probes, said acoustic detector adapted to transmit information in the form of electronic signals to said remote sensing station.

19. A method as claimed in claim 14, comprising the further step of mounting each of said wands in a generally upright position on a base (24), and anchoring said base to a surface within an avalanche start zone.

20. A method as claimed in claim 14, comprising the further steps of measuring the temperature of said snow pack adjacent each of said probes by means of temperature sensing means (62) adapted to transmit an electronic signal indicating the information received by said temperature sensing means, and transmitting data relating to said temperature to said remote sensing station.

21. A method as claimed in claim 20, comprising the further steps of measuring the temperature of the snow pack adjacent each of said probes at more than one vertical position within the snow pack by providing multiple of said temperature sensing means within each of said probes.

22. A method as claimed in claim 14, comprising the further step of suspending each of said wands from a transverse element (162) suspended above an avalanche track, wherein the base of said wands is positioned above the upper surface of said snow pack.

23. A method as claimed in claim 22, comprising the further step of transmitting a radio signal receivable at an audible frequency upon the generation of said electronic signal by said tilt meter.

* * * * *